US006934480B2

(12) United States Patent
Shim et al.

(10) Patent No.: US 6,934,480 B2
(45) Date of Patent: Aug. 23, 2005

(54) DEVICE AND METHOD FOR MEASURING IMAGE DENSITY

(75) Inventors: Woo-Jung Shim, Suwon (KR); Yong-Geun Kim, Suwon (KR); Min-Seon Kim, Suwon (KR); Seung-Deog An, Yongin (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/237,801

(22) Filed: Sep. 10, 2002

(65) Prior Publication Data

US 2003/0068168 A1 Apr. 10, 2003

(30) Foreign Application Priority Data

Oct. 5, 2001 (KR) ..... 2001-61324

(51) Int. Cl.[7] ..... G03G 15/00; G03G 15/10; G03G 15/11

(52) U.S. Cl. ..... 399/49; 399/57; 399/60; 399/249; 399/251

(58) Field of Search ..... 399/27, 29, 30, 399/49, 57, 58, 60, 92, 237, 249, 251

(56) References Cited

U.S. PATENT DOCUMENTS 4,632,537 A * 12/1986 Imai ..... 399/29
5,713,062 A * 1/1998 Goodman et al. ..... 399/49
5,903,796 A * 5/1999 Budnik et al. ..... 399/49 X
5,920,748 A * 7/1999 Kawai et al. ..... 399/60 X
6,034,703 A * 3/2000 Broddin et al. ..... 399/49 X
6,178,304 B1 * 1/2001 Sakai ..... 399/251
6,198,886 B1 * 3/2001 Brewington ..... 399/49
6,233,420 B1 * 5/2001 Liu et al. ..... 399/237
6,243,118 B1 * 6/2001 Akichika et al. ..... 399/237 X
6,415,124 B1 * 7/2002 Nishikawa ..... 399/237

FOREIGN PATENT DOCUMENTS

JP 11-344846 * 12/1999
JP 2001-134104 * 5/2001

* cited by examiner

*Primary Examiner*—Sandra L. Brase
(74) *Attorney, Agent, or Firm*—Sughrue Mion, PLLC

(57) ABSTRACT

Disclosed is a device for measuring the density of an image in regard to a liquid test patch. The device has: a fan for drying a test patch by blowing air to the test patch disposed on at least one of a photosensitive medium, a photosensitive belt and printing paper; a sensor for projecting infrared light to the dried test patch and measuring the density of the test patch based on the reflected light of the infrared light reflected from the test patch; and an adjustment unit for adjusting the mixing ratio of a toner and a carrier in accordance with the measured density. The device measures the amount of light reflected from the dried liquid test patch, thus allowing the density of the image to be measured accurately.

28 Claims, 3 Drawing Sheets

DEVICE AND METHOD FOR MEASURING IMAGE DENSITY

BACKGROUND OF THE INVENTION

1. Field of the Invention

The present invention relates to a device and a method for measuring image density, and more particularly, to a device and a method for measuring image density of liquid toner. The present application is based on Korean Patent Application No. 2001-61324, filed on Oct. 5, 2001, which is incorporated herein by reference.

2. Description of the Prior Art

Generally, a photosensitive medium such as a photosensitive belt or a photosensitive drum is used in an image forming apparatus. The surface of the photosensitive medium can be charged. Moreover, an electrostatic latent image can be formed on the surface of the photosensitive medium as an electric potential level is selectively converted by the projection of a beam. The image forming apparatus is divided into a dry-type and a wet-type according to the type of toner applied to the electrostatic latent image. The wet-type image forming apparatus uses a developing solution in which a liquid toner and a carrier are mixed.

FIG. 1 is a view schematically showing a conventional image forming apparatus.

Referring to FIG. 1, the image forming apparatus has: a photosensitive belt 14 supported by a driving roller 11, a steering roller 12, a counter roller 13 and rotated on a caterpillar; a plurality of developers 17*a*, 17*b*, 17*c* and 17*d;* and a transferring roller 25.

The surface of the photosensitive belt 14 can be maintained in a charged state by a corona device 16. The charged state of the surface of the photosensitive belt 14 can be changed by a laser beam projected from a plurality of laser projection units 18*a*, 18*b*, 18*c* and 18*d* disposed close to the developers 17*a*, 17*b*, 17*c* and 17*d*. The beam projection of the laser projection units 18*a*, 18*b*, 18*c* and 18*d* forms the electrostatic latent image on the photosensitive belt 14.

The developers 17*a*, 17*b*, 17*c* and 17*d* can develop colors such as black, yellow, cyan and magenta according to the pigment color. Moreover, each of the laser projection units 18*a*, 18*b*, 18*c* and 18*d* forms a part of the electrostatic latent image in regard to a corresponding color. The developers 17*a*, 17*b*, 17*c* and 17*d*, are filled with developing solution, which can be applied to the electrostatic latent image formed on the surface of the photosensitive belt 14 by a plurality of development rollers 22*a*, 22*b*, 22*c* and 22*d* respectively disposed at the developers 17*a*, 17*b*, 17*c* and 17*d*. The developing solution attached to the electrostatic latent image forms test patches on a printing paper 27. The test patches constitute a visible image and the test patches have a tone area coverage different from each other and different from a half tone.

A cleaning roller 23 has a function of completely removing the carrier from the test patches formed on the photosensitive belt 14. A heating roller 24 supports the function of the cleaning roller 23 by evaporating the carrier. A toner image formed on the photosensitive belt 14 is transferred to the transferring roller 25. The toner image can be transferred from the transferring roller 25 to the printing paper 27 due to a difference in surface energy. The printing paper 27 passes between the transferring roller 25 and a settled roller 26. An eraser 15 allows a new electrostatic latent image to be formed by performing a function of removing the remaining charge from the photosensitive belt 14.

The developing solution in the developers 17*a*, 17*b*, 17*c* and 17*d* is a liquid mixture of the toner and the carrier. The toner is stored in a plurality of toner containers 19*a*, 19*b*, 19*c* and 19*d*, and is supplied to a plurality of mixing containers 21*a*, 21*b*, 21*c* and 21*d*, by a plurality of pumps 20*a*, 20*b*, 20*c* and 20*d*. The carrier is stored in a carrier container 28 and is supplied to each of the mixing containers 21*a*, 21*b*, 21*c* and 21*d*. The toner and the carrier are mixed in the mixing containers 21*a*, 21*b*, 21*c* and 21*d* to an appropriate density. The toner/carrier mixtures are supplied to the developers 17*a*, 17*b*, 17*c* and 17*d* by the pumps 22*a*, 22*b*, 22*c* and 22*d*. The carrier container 28 also stores the carrier returned from a cleaning device having the cleaning roller 23 and the heating roller 24.

In the above image forming apparatus, the density of the developing solution supplied by each of the developers 17*a*, 17*b*, 17*c*, 17*d* should be maintained constant to obtain an image of an appropriate density. In other words, the mixing ratio of the toner and the carrier should be maintained at an appropriate level. The appropriate level can be realized by adjusting the amount of toner and carrier supplied respectively from the toner containers 19*a*, 19*b*, 19*c* and 19*d*, and the carrier container 28. In addition, to adjust the mixing ratio of the toner and the carrier, there should be a device for detecting the density of the image.

FIG. 2 is a view schematically showing the image forming apparatus having a conventional image density measurement device. Here, the same reference numerals are used to designate the same elements of FIG. 1.

Referring to FIG. 2, the image forming apparatus has a plurality of developing solution density adjustment devices 30*a*, 30*b*, 30*c* and 30*d* and an image density measurement device 41. The image density measurement device 41 is realized by a CTD (Color Toner Density) sensor.

The development density adjustment devices 30*a*, 30*b*, 30*c* and 30*d* maintain the density of the developing solution supplied to each of the developers 17*a*, 17*b*, 17*c* and 17*d* regularly. The density of the developing solution can be kept constant by adjusting the amount of toner and carrier respectively supplied from the toner containers 19*a*, 19*b*, 19*c* and 19*d* and the carrier container 28 to each of the mixing containers 21*a*, 21*b*, 21*c* and 21*d*.

The CTD sensor 41 projects an infrared ray to the test patches, having tone areas different from each other and from the half tone, created on the printing paper 27. Although not shown, the CTD sensor 41 may project an infrared ray to test patches on the photosensitive medium or on a photosensitive drum. After that, the CTD sensor 41 measures the density of the image of the test patches by converting the light (a regular reflection light or a scattered reflection right) reflected from the test patches to an electrical signal by using a light-receiving element such as a photodiode. In other words, the CTD sensor 41 transmits the converted electrical signal to a controller (not shown). When the controller receives the electrical signal from the CTD sensor 41, the controller judges the density of the image corresponding to the transmitted electric signal by referring to a look-up table stored in a memory (not shown). By doing so, the density of the image is measured, and the controller can control the mixing ratio of the toner and the carrier in accordance with the measured density of the image.

However, in the test patches of the wet-type image forming apparatus using liquid toner, there is liquid carrier mixed with the toner (generally, the liquid used as the carrier is normal paraffin, but silicon oil and vegetable oil are being studied for use as a liquid carrier). Accordingly, the light projected to the test patches from the CTD sensor 41 is refracted and reflected at the surface of the test patches. The characteristic of the light which is refracted and reflected is changed as the carrier dries. In other words, the characteristic of the light is changed as a medium is added to the path of the light refracted or reflected from the test patches. In addition, since the amount of the reflected light measured in accordance with the range of the test patches is neither linear nor constant, the measured value differs from measurement to measurement. Therefore, the density of the image cannot be measured accurately.

SUMMARY OF THE INVENTION

The present invention has been made to overcome the abovementioned problems of the prior art. Accordingly, it is the object of the present invention to provide a device and a method for accurately measuring the density of an image of liquid toner by keeping constant the dried status of a test patch of the liquid toner.

The image density measurement device of the present invention to accomplish the above object comprises: a fan for drying a test patch by blowing air to the test patch disposed on at least one of a photosensitive medium, a photosensitive belt and printing paper; an image density sensor for projecting an infrared light to the dried test patch and measuring a density of the test patch based on the infrared light reflected from the test patch; and a developing solution density adjustment unit for adjusting a mixing ratio of a toner and a carrier in accordance with the measured density.

A heater is disposed at the rear of the fan in order to heat the air supplied to the test patch. The temperature of the air heated by the heater is measured by a temperature sensor. The heater is controlled to maintain the measured temperature below a predetermined temperature. Accordingly, the image density measurement device can accurately measure the image density of the liquid toner by maintaining the dried status of the liquid toner with respect to the test patch.

On the other hand, according to the present invention, an image density measuring method comprises the steps of: drying a test patch by blowing air to the test patch disposed on at least one of a photosensitive medium, a photosensitive belt and printing paper; measuring the density of the test patch by projecting an infrared light to the dried test patch and measuring the density of the test patch based on the infrared light reflected from the test patch; and adjusting a mixing ratio of a toner and a carrier in accordance with the measured density.

BRIEF DESCRIPTION OF THE DRAWINGS

The above-mentioned object and the feature of the present invention will be more apparent by describing the preferred embodiment of the present invention by referring to the appended drawings, in which.

DESCRIPTION OF THE PREFERRED EMBODIMENT

Figure 1:
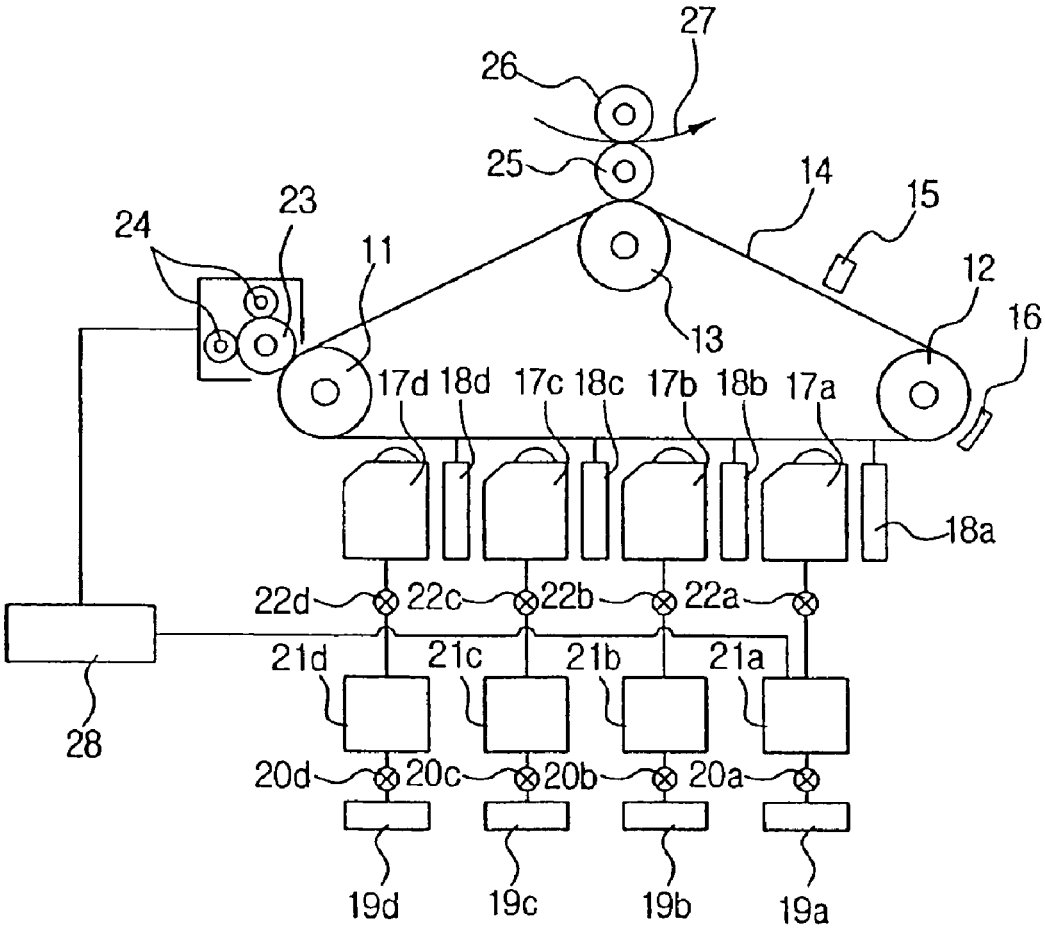
FIG. 1 PRIOR ART
FIG. 1 is a view schematically showing a conventional image forming apparatus.
Figure 2:
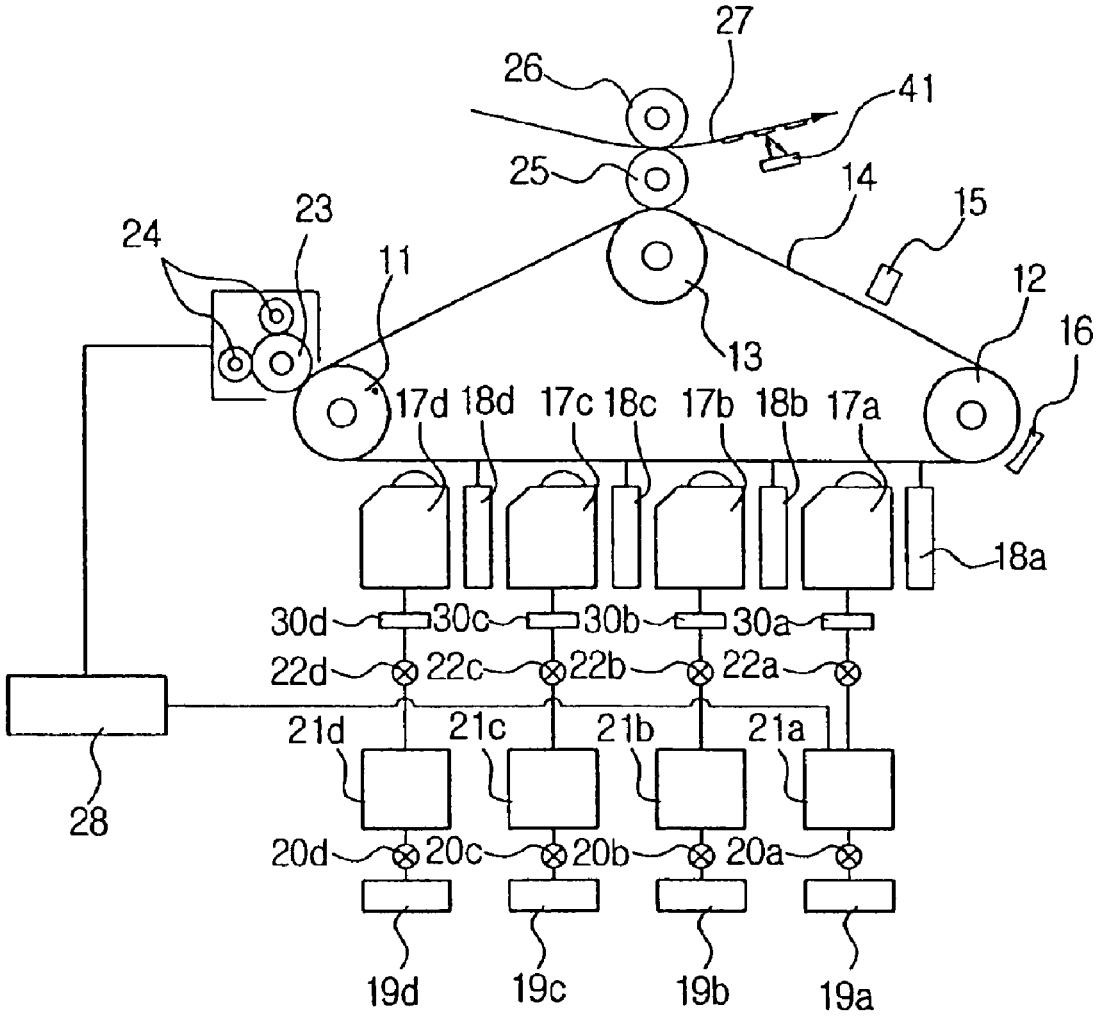
FIG.2 PRIOR ART
FIG. 2 is a view schematically showing an image forming apparatus having a conventional image density measurement device.
Figure 3:
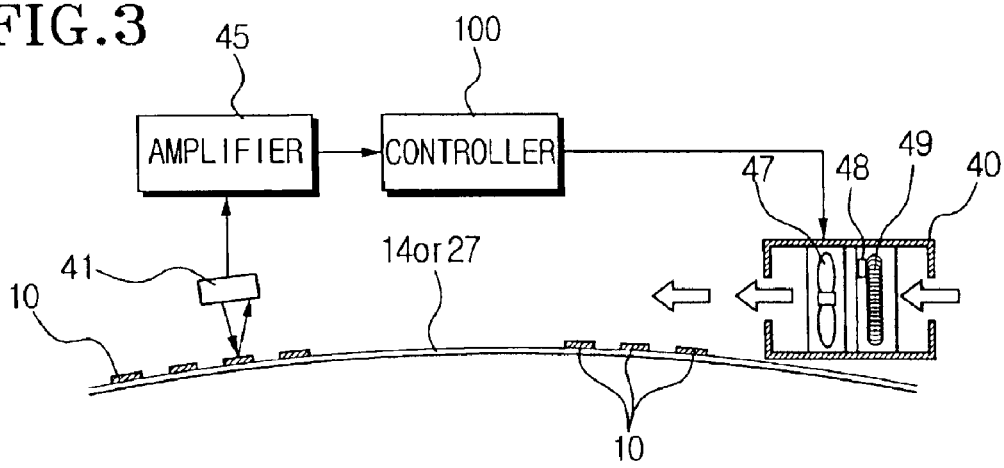
FIG. 3 is a view schematically showing the preferred embodiment of the image density measurement device according to the present invention.

FIG. 3 is a view schematically showing a preferred embodiment of an image density measurement device of an image forming apparatus according to the present invention. The image density measurement device is disposed in the image forming apparatus of FIG. 2. Here, the general operation of the image forming apparatus will be described referring to FIG. 2. Referring to FIG. 3, the image density measurement device is comprised of an image density sensor 41, an amplifier 45, a drier 40 and a controller 100. The drier 40 has a fan 47, a temperature sensor 48 and a heater 49.

The image density sensor 41 is realized by a CTD sensor. The image density sensor projects infrared light to test patches having tone ranges different from each other and from a half tone generated on a photosensitive medium, a photosensitive drum or a printing paper 27. Then, the image density sensor 41 measures the density of the image of the test patches by converting light (regular reflection light or scattered reflection right) reflected from the test patches to an electrical signal by using a light-receiving element such as a photodiode. The electrical signal converted by the image density sensor 41 is amplified by the amplifier 45, and transmitted to the controller 100.

The controller 100 provides overall control of the components needed to form the image with the image forming apparatus. When the controller 100 receives the electrical signal amplified by the amplifier 45, the controller 100 measures the density of the image corresponding to the transmitted electrical signal by referring to a look-up table stored in a memory (not shown). The controller 100 can adjust a mixing ratio of the toner and carrier through a plurality of density adjustment devices 30*a*, 30*b*, 30*c* and 30*d* according to the measured density of the image.

The fan 47 dries the liquid test patches by supplying a predetermined amount of air to the test patches 10 formed on at least one of the photosensitive medium, the photosensitive belt 14 and the printing paper 27.

The heater 49 is disposed at the rear of the fan 47 upstream of the oncoming air, and heats the air supplied by the fan 47 to the test patch 10. The temperature sensor 48 senses the temperature of the air heated by the heater 49. The temperature of the air sensed by the temperature sensor 48 is converted to an electrical signal and transmitted to the controller 100. The controller 100 receives the electrical signal from the temperature sensor 48 in regard to the temperature of the heated air, and controls the temperature of the heater 49 according to the transmitted electrical signal. Especially, when the temperature of the air heated by the heater 49 is higher than the melting point of the liquid toner, the test patches 10 are melted, thus the controller 100 controls the heater 49 so that the temperature of the air heated by the heater 49 is not higher than the melting point of the liquid toner. Here, it has been described that the heater is disposed at the rear of the fan 47 and heats the air drawn by the fan 47. However, the heater 49 can be disposed at the front of the fan 47 in the flow direction of the air so as to heat the air coming out from the fan 47.

Figure 4:
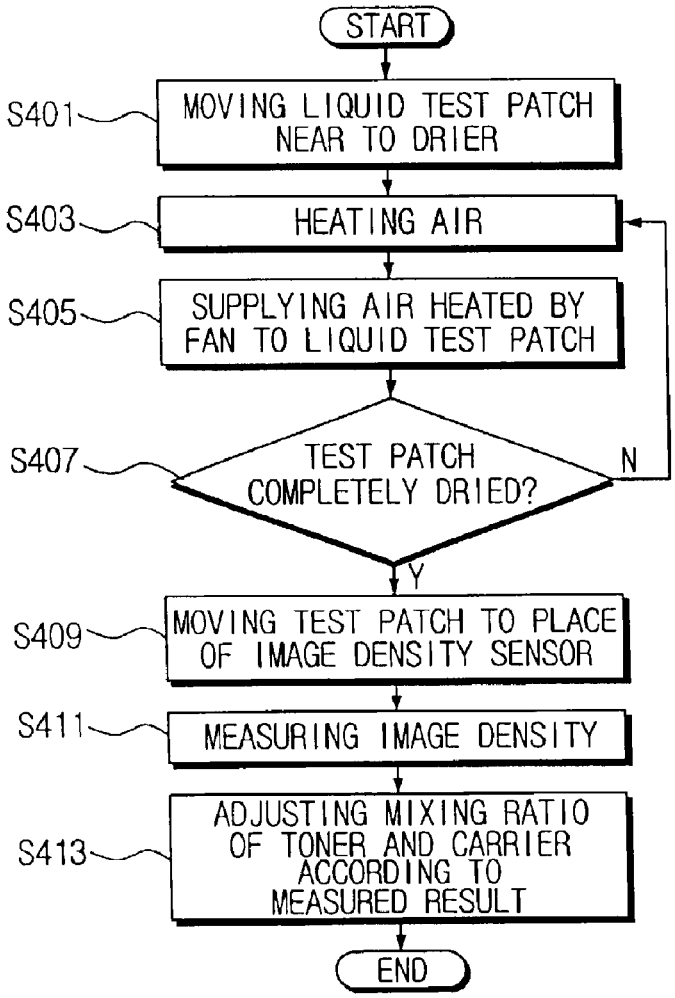
FIG. 4 is a flow chart showing an image density measuring method of FIG. 3.

FIG. 4 is a flow chart showing the method for measuring the density of an image using the image density measurement device of FIG. 3.

Hereinbelow, the operation of the image density measurement device according to the present invention will be described referring to FIG. 4.

When the developing solution forms the test patches on the surface of the photosensitive belt 14 or the printing paper 27 by being attached thereon through a plurality of development rollers 20*a*, 20*b*, 20*c* and 20*d* respectively disposed at a plurality of developers 17*a*, 17*b*, 17*c* and 17*d*, the controller 100 moves the photosensitive belt 14 or the printing paper 27 so that the liquid test patches 10 can be placed near the drier 40 (S 401).

When the photosensitive belt 14 or the printing paper 27 is placed near the drier 40, the controller 100 heats the predetermined air by operating the heater 49 disposed at the drier 40 (S 403). Moreover, the controller 100 supplies the air heated by the heater 49 to the liquid test patches 10 by operating the fan 47 disposed at the drier 40 (S 405). The air heated by the fan 47 and the heater 49 allows the test patches 10 to be dried by evaporating moisture included in the test patch 10.

In the meantime, there are some elements which affect the degree to which the liquid toner is dried: the temperature of the heated air supplied to the test patches 10; the amount of heated air supplied to the test patches 10 per unit time; the angle at which the heated air reaches the test patches 10; and the melting point of the ink from which the test patches 10 are formed. The controller 100 in the preferred embodiment of the present invention adjusts the amount of air supplied to the test patches 10 by controlling the speed of the fan 47. In addition, the controller 100 adjusts the temperature of the air supplied to the test patches 10 by controlling the temperature of the heater 49.

When it is judged that a predetermined time has passed after the heated air is supplied to the test patches 10, or the sensor (not shown) disposed separately to sense the dried status of the test patches 10 judges that the test patches 10 are dried completely (S 407), the controller 100 operates the photosensitive belt 14 or the printing paper 27 to move the test patches 10 to the area of the image density sensor 41 (S 409). When the test patches 10 are moved to the area of the image density sensor 41, the image density sensor 41 measures the density of the image of the test patches 10 (S 411). The density of the image measured by the image density sensor 41 is transmitted to the amplifier 45 after being converted to an electrical signal by the light-receiving element. The amplifier 45 transmits the electrical signal transmitted from the image density sensor 41 to the controller 100.

The controller 100 refers to the look-up table stored in the memory (not shown) to determine the density of the image corresponding to the electrical signal transmitted from the amplifier 45. When the measured image density corresponding to the electrical signal is determined using the look-up table, the controller 100 can adjust the mixing ratio of the toner and the carrier by controlling the developing solution density adjustment devices 30*a*, 30*b*, 30*c* and 30*d* in accordance with the measured result (S413).

Accordingly, the image density sensor 41 can sense the amount of the reflected light in regard to the test patches 10 dried with a predetermined drying degree. Therefore, the density of the image can be measured accurately and reliably.

According to the present invention, the image density measurement device measures the amount of light reflected from the liquid test patches, thus the density of the image with respect to the liquid test patches can be measured accurately and reliably.

Although the preferred embodiment of the present invention has been described, it will be understood by those skilled in the art that the present invention should not be limited to the described preferred embodiment, but various changes and modifications can be made within the spirit and the scope of the present invention. For example, the test patches may be dried by means other than a fan and heater. Any element or combination of elements which can provide controlled drying of the test patches may be used. By way of example, but not by way of limitation, a device which emits energizing rays, such as infrared rays, may be used to dry the test patches. Alternately, the test patches may be dried by directly applying a heated object to the photosensitive element containing the test patches. Also, the image density sensor can be any device capable of measuring the density of the test patches, and need not be a device which projects infrared light onto the test patch to make such measurement. Accordingly, the scope of the present invention is not limited within the described range but only by the following claims.

What is claimed is:

1. An image density measurement device comprising:

a cleaning roller for removing a carrier from a test patch;

a fan, arranged downstream of the cleaning roller, for drying the test patch by blowing air to the test patch;

an image density sensor for projecting an infrared light to the dried test patch so that at least part of the infrared light is reflected, and measuring a density of the test patch based on the reflected light; and a developing solution density adjustment unit for adjusting a mixing ratio of a toner and a carrier in accordance with the measured density, wherein the fan is arranged to blow air on the test patch when the test patch is on at least one of a photosensitive medium, a photosensitive belt and a printing paper.

2. The image density measurement device of claim 1, further comprising a heater for heating the air blown to the test patch by the fan.

3. The image density measurement device of claim 2, further comprising a temperature sensor for measuring a temperature of the heated air, wherein the heater is controlled to maintain the measured temperature below a predetermined temperature.

4. An image density measuring method comprising the steps of:

removing a carrier from a test patch by contact absorption;

drying a test patch by blowing air to the test patch after the removing of the liquid toner;

measuring a density of the test patch by projecting an infrared light to the dried test patch so that at least part of the infrared light is reflected from the dried test patch, and measuring a density of the test patch based on the reflected light of the infrared light reflected from the dried test patch; and adjusting a mixing ratio of a toner and a carrier in accordance with the measured density, wherein the test patch is dried by blowing air when the test patch is on at least one of a photosensitive medium, a photosensitive belt and a printing paper.

5. The image density measuring method of claim 4, further comprising a step of heating the air blown to the test patch.

6. The image density measuring method of claim 5, further comprising a step of measuring a temperature of the heated air, wherein the heating step maintains the measured temperature below a predetermined temperature in the heating step.

7. An image density measurement device comprising:

a cleaning roller for removing a carrier from a test patch;

a unit, arranged downstream of the cleaning roller, for drying the test patch;

an image density sensor for measuring a density of the dried test patch; and a developing solution density adjustment unit for adjusting a mixing ratio of a toner and a carrier in accordance with the measured density, wherein the unit is arranged to dry the test patch when the test patch is on at least one of a photosensitive medium, a photosensitive belt and a printing paper, and is spaced away from the test patch.

8. The image density measurement device of claim 7, further comprising:

a heater for heating the air blown to the test patch by the fan; and a temperature sensor for measuring a temperature of the heated air, wherein the heater is controlled to maintain the measured temperature below a predetermined temperature.

9. An image density measuring method comprising the steps of:

removing a carrier from a test path by contact absorption;

drying a test patch after the removing of the liquid toner;

measuring a density of the test patch; and adjusting a mixing ratio of a toner and a carrier in accordance with the measured density, wherein the test patch is dried when the test patch is on at least one of a photosensitive medium, a photosensitive belt and a printing paper, and wherein the test patch is dried by a non-contact method.

10. The image density measuring method of claim 9, further comprising:

heating the air blown to the test patch; and measuring a temperature of the heated air, wherein the heating step maintains the measured temperature below a predetermined temperature in the heating step.

11. An image density measurement device comprising:

a photosensitive belt for transferring a test patch to a printing paper;

a fan for drying the test patch by blowing air to the test patch disposed on the printing paper;

an image density sensor for projecting an infrared light to the dried test patch so that at least part of the infrared light is reflected, and measuring a density of the test patch based on the reflected light; and a developing solution density adjustment unit for adjusting a mixing ratio of a toner and a carrier in accordance with the measured density.

12. The image density measurement device of claim 11, further comprising a heater for heating the air blown to the test patch by the fan.

13. The image density measurement device of claim 12, further comprising a temperature sensor for measuring a temperature of the heated air, wherein the heater is controlled to maintain the measured temperature below a predetermined temperature.

14. An image density measuring method comprising the steps of:

transferring a test patch from a photosensitive belt to a printing paper;

drying the test patch by blowing air to the test patch disposed on the printing paper;

measuring a density of the test patch by projecting an infrared light to the dried test patch so that at least part of the infrared light is reflected from the dried test patch, and measuring a density of the test patch based on the reflected light of the infrared light reflected from the dried test patch; and adjusting a mixing ratio of a toner and a carrier in accordance with the measured density.

15. The image density measuring method of claim 14, further comprising a step of heating the air blown to the test patch.

16. The image density measuring method of claim 15, further comprising a step of measuring a temperature of the heated air, wherein the heating step maintains the measured temperature below a predetermined temperature in the heating step.

17. An image density measurement device comprising:

a photosensitive belt for transferring a test patch to a printing paper;

a unit for drying a the test patch disposed on a the printing paper;

an image density sensor for measuring a density of the dried test patch; and a developing solution density adjustment unit for adjusting a mixing ratio of a toner and a carrier in accordance with the measured density.

18. The image density measurement device of claim 17, further comprising:

a heater for heating the air blown to the test patch by the fan; and a temperature sensor for measuring a temperature of the heated air, wherein the heater is controlled to maintain the measured temperature below a predetermined temperature.

19. An image density measuring method comprising the steps of:

transferring a test patch from a photosensitive belt to a printing paper;

drying the test patch disposed on the printing paper;

measuring a density of the test patch; and adjusting a mixing ratio of a toner and a carrier in accordance with the measured density.

20. The image density measuring method of claim 19, further comprising:

heating the air blown to the test patch; and measuring a temperature of the heated air, wherein the heating step maintains the measured temperature below a predetermined temperature in the heating step.

21. An image density measurement device comprising:

a fan for drying a test patch by blowing air to the test patch disposed on a printing paper;

an image density sensor for projecting an infrared light to the dried test patch so that at least part of the infrared light is reflected, and measuring a density of the test patch based on the reflected light;

a developing solution density adjustment unit for adjusting a mixing ratio of a toner and a carrier in accordance with the measured density;

a heater for heating the air blown to the test patch by the fan; and a temperature sensor for measuring a temperature of the heated air, wherein the heater is controlled to maintain the measured temperature below a predetermined temperature.

22. An image density measuring method comprising the steps of:

drying a test patch by blowing air to the test patch disposed on a printing paper;

measuring a density of the test patch by projecting an infrared light to the dried test patch so that at least part of the infrared light is reflected from the dried test patch, and measuring a density of the test patch based on the reflected light of the infrared light reflected from the dried test patch;

adjusting a mixing ratio of a toner and a carrier in accordance with the measured density;

heating the air blown to the test patch; and measuring a temperature of the heated air;

wherein the heating step maintains the measured temperature below a predetermined temperature in the heating step.

23. An image density measurement device comprising:

a unit for drying a test patch disposed on a printing paper;

an image density sensor for measuring a density of the dried test patch;

a developing solution density adjustment unit for adjusting a mixing ratio of a toner and a carrier in accordance with the measured density; a heater for heating the air blown to the test patch by the fan; and a temperature sensor for measuring a temperature of the heated air, wherein the heater is controlled to maintain the measured temperature below a predetermined temperature.

24. An image density measuring method comprising the steps of:

drying a test patch disposed on a printing paper;

measuring a density of the test patch;

adjusting a mixing ratio of a toner and a carrier in accordance with the measured density;

heating the air blown to the test patch; and measuring a temperature of the heated air, wherein the heating step maintains the measured temperature below a predetermined temperature in the heating step.

25. An image density measurement device comprising:

a fan for drying a test patch by blowing air to the test patch disposed on at least one of a photosensitive medium, a photosensitive belt and a printing paper;

an image density sensor for projecting an infrared light to the dried test patch so that at least part of the infrared light is reflected, and measuring a density of the test patch based on the reflected light;

a developing solution density adjustment unit for adjusting a mixing ratio of a toner and a carrier in accordance with the measured density;

a heater for heating the air blown to the test patch by the fan;

a temperature sensor for measuring a temperature of the heated air, wherein the heater is controlled to maintain the measured temperature below a predetermined temperature.

26. An image density measuring method comprising the steps of:

drying a test patch by blowing air to the test patch disposed on at least one of a photosensitive medium, a photosensitive belt and a printing paper;

measuring a density of the test patch by projecting an infrared light to the dried test patch so that at least part of the infrared light is reflected from the dried test patch, and measuring a density of the test patch based on the reflected light of the infrared light reflected from the dried test patch; and adjusting a mixing ratio of a toner and a carrier in accordance with the measured density;

heating the air blown to the test patch; and measuring a temperature of the heated air, wherein the heating step maintains the measured temperature below a predetermined temperature in the heating step.

27. An image density measurement device comprising:

a unit for drying a test patch disposed on at least one of a photosensitive medium, a photosensitive belt and a printing paper;

an image density sensor for measuring a density of the dried test patch;

a developing solution density adjustment unit for adjusting a mixing ratio of a toner and a carrier in accordance with the measured density;

a heater for heating the air blown to the test patch by the fan; and a temperature sensor for measuring a temperature of the heated air, wherein the heater is controlled to maintain the measured temperature below a predetermined temperature.

28. An image density measuring method comprising the steps of:

drying a test patch disposed on at least one of a photosensitive medium, a photosensitive belt and a printing paper;

measuring a density of the test patch;

adjusting a mixing ratio of a toner and a carrier in accordance with the measured density;

heating the air blown to the test patch; and measuring a temperature of the heated air, wherein the heating step maintains the measured temperature below a predetermined temperature in the heating step.

* * * * *